United States Patent [19]

Koch

[11] 3,988,107

[45] Oct. 26, 1976

[54] SAGGER CONSTRUCTION

[75] Inventor: David C. Koch, Zanesville, Ohio

[73] Assignee: Ferro Corporation, Cleveland, Ohio

[22] Filed: Aug. 12, 1975

[21] Appl. No.: 604,001

[52] U.S. Cl. ..... 432/258; 432/253

[51] Int. Cl.[2] ..... F27D 5/00

[58] Field of Search ..... 432/253, 258, 259

[56] References Cited

UNITED STATES PATENTS

| | | | |
|---|---|---|---|
| 971,228 | 9/1910 | Vance | 432/258 |
| 1,286,747 | 12/1918 | Owens | 432/258 |
| 1,336,762 | 4/1920 | Swinnerton | 432/258 |
| 1,384,468 | 7/1921 | Howell | 432/259 |
| 1,846,614 | 2/1932 | Rowland | 432/253 |
| 3,319,948 | 5/1967 | Olsen | 432/253 |

*Primary Examiner*—John J. Camby

*Attorney, Agent, or Firm*—Milton L. Simmons; Wesley B. Taylor

[57] ABSTRACT

A sagger construction is disclosed for holding refractory articles during firing. The construction comprises at least two, separable, normally bottomless, topless, multi-sided saggers placed atop each other in substantial vertical alignment to define a hollow columnar enclosure which is adapted to contain the refractory articles. The topmost sagger defines an entrance to the columnar enclosure, while the bottommost sagger has closure means along the bottom thereof and contains exit means for release of the refractory articles such as after firing. This construction not only substantially increases the volume of refractory material which can be fired at one time, but also appreciably reduces labor requirements while prolonging the useful life of the individual saggers.

10 Claims, 5 Drawing Figures

SAGGER CONSTRUCTION

BACKGROUND OF THE INVENTION

Various refractory or ceramic articles are prepared by firing a shaped, green refractory clay at elevated temperatures. Hard refractory balls, such as those used in grinding mills, are commonly prepared in this manner. The balls, or other refractory articles, are piled in saggers which are four-sided boxes having a floor but open at the top. The saggers are also fabricated from fired refractory material such as fire clay.

The present practice of using saggers is laborious and time-consuming. Present techniques often do not take full advantage of the volume of the saggers, resulting in decreased volume of product and waste of heat energy in a kiln. A laborer must manually fill each sagger box with the heavy refractory articles to be fired and then lift and place the sagger box on a kiln car which subsequently carries the sagger into a kiln for firing. Usually a sagger is not completely filled with the refractory articles, resulting in loss of capacity. The laborer must repeat this individual filling, lifting, and placing of each sagger box, normally placing a filled sagger atop another, until a number of saggers are stacked atop each other. There are usually a number of stacks of saggers loaded on a kiln car, each sagger having been manually filled and placed one at a time on the car.

After the car is fired in a kiln and then removed, the procedure must be reversed. The laborer must again take each sagger, heavy with fired product, from its stack and empty its contents. This individual treatment of each sagger is continued until all have been separately unloaded.

In addition, since the saggers are repeatedly subjected to quite high firing temperatures, such as 2650° F, a sagger does not have a long useful life. Sides of a sagger box tend to bow, warp, or crack due to repeated heats. The floors of the saggers are particularly susceptible to this and can become so slumped or otherwise misshapen as to require removal of the sagger from service.

SUMMARY OF THE INVENTION

The principal object of the present invention is to provide a sagger construction which has increased capacity for articles to be fired, substantially reduces labor requirements to a point of becoming semi-automated in loading and unloading, and which has prolonged useful life.

It has been discovered that these and other objects can be realized by removing, in effect, the floors of the sagger boxes, while still preserving the individuality and separability of each sagger box, to form a hollow columnar enclosure which can remain in place on a kiln car for substantial periods of service.

In one form, the present sagger construction comprises at least two, multi-sided, closed frame members or sagger boxes which are otherwise completely open, that is, they have neither top nor bottom. In practice, the frame members are placed atop each other in substantially vertical alignment to define a hollow column or columnar enclosure. This enclosure is designed to hold the articles to be fired. The top, open area of the topmost sagger box or sagger defines an entrance through which the column may be charged with refractory articles to be fired. The bottommost sagger has closure means to contain the articles within the column and is provided with exit gate means for release of the refractory articles, for example, after they have been fired.

The individual entity of each sagger in a column is still important. When necessary, such an enclosure can be assembled or disassembled by one laborer and to a desired, adjustable height, as contrasted with having to handle an integral, relatively large, one-size column. Also the ability to separate individual saggers which comprise a given column from each other enables the saggers to be rotated with respect to each other, thereby promoting even wear on all the saggers from repeated heats.

Elimination of the floor of each sagger (with the possible exception of the bottommost sagger) increases the volume or capacity of a sagger column, since the entire volume of the column can now be utilized and not be interrupted at spaced intervals by the floors of saggers as was the case in prior sagger constructions. Elimination of the floor or bottom of each sagger also eliminates the problems of bowing and cracking previously encountered during the use of such sagger bottoms and thereby substantially extends the useful life of the saggers.

To seal the bottom of the bottommost sagger and prevent loss of refractory articles from the sagger column, a slab may underseat the bottommost sagger and support the column; or space-apart bricks can be used for this purpose, the bricks also being used to raise the saggers of the column and aid in air circulation through the column; or an integral floor or bottom can be attached to the bottommost sagger to make it the only sagger to have a bottom.

Optionally, the saggers may have interengaging means to aid in retaining them in a substantial vertical alignment, and the saggers may have slot portions along their upper edges which serve a dual purpose of air-circulation vents and finger grips.

DESCRIPTION OF THE PREFERRED EMBODIMENTS

Figure 1:
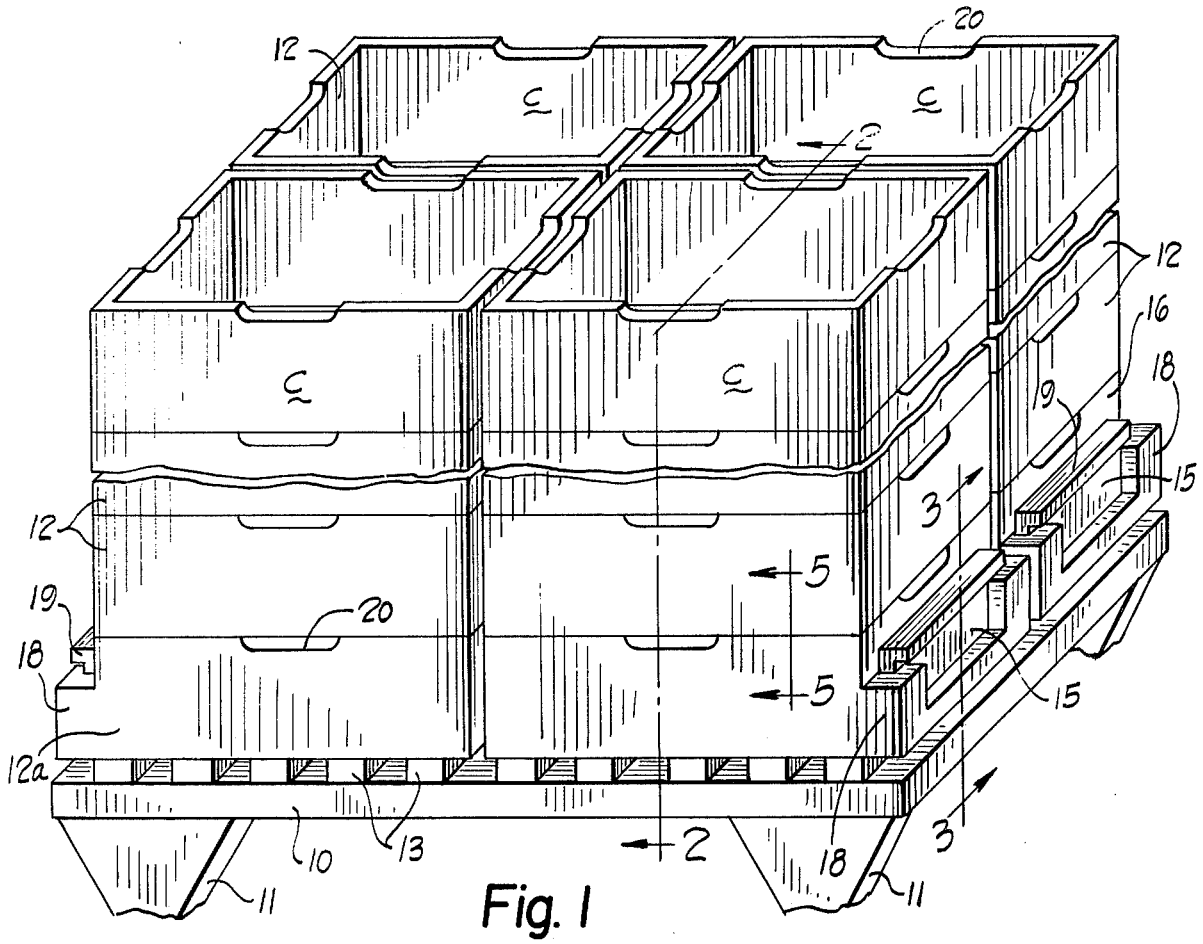
FIG. 1 is a perspective view of a kiln car supporting four columns of saggers of the present invention.
Figure 2:
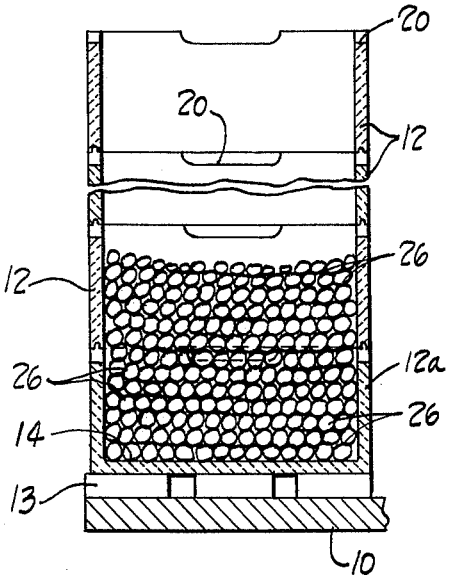
FIG. 2 is a cross-section of one of the columns of FIG. 1 on the line 2—2 and illustrates how balls may entirely fill the column unimpeded by sagger floors normally a part of a sagger construction.

Referring initially to FIGS. 1 and 2, the disclosed embodiment includes a kiln car having a flat metallic and/or refractory bed 10 provided with feet 11 to which suitable rollers or wheels (not shown) may be conventionally secured for moving the car in and out of a kiln.

The bed 10 of the kiln car is shown as supporting four columns C of saggers 12, although the number of columns is only a function of the size of the kiln car, and the number of saggers in a column can be two or more up to any practical number. Each sagger column C may be of the same construction. Preferably, conventional, spaced-apart bricks 13 are used to support columns C over bed 10 of the kiln car to aid in circulation of air through the columns while they are heated in the kiln.

As indicated in FIGS. 1 and 2, saggers 12 are four-sided frame members generally completely open at the top and bottom. These saggers as well as those hereinafter described may be conventionally cast and fired as one integral piece from any suitable refractory material, for example, from the same refractory material as the articles the saggers may later contain during use. Fire clay may be used for fabricating the saggers or such other specific materials as aluminum silicate, zirconium silicate, refractory oxides and the like, or combinations of these materials.

Figure 3:
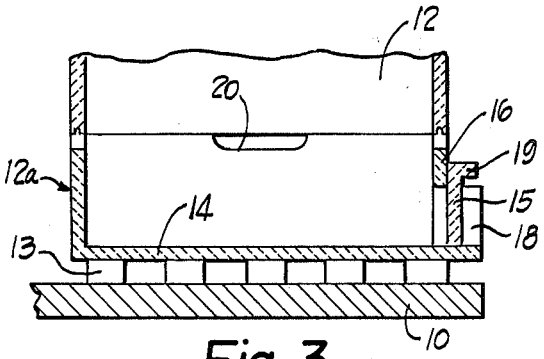
FIG. 3 is a cross-section of a bottommost sagger taken on the line 3—3 of FIG. 1 and shows an exit gate for that sagger.

The bottommost sagger 12*a* of FIGS. 1 and 2 is shown with an integral floor 14, although this is not essential. However, the bottommost sagger 12*a* of each column C is different from the others in its stack in that it has exit means for release of the refractory articles carried by a column. In the embodiment of FIGS. 1 and 3, such exit means may take the form of an L-shaped lift gate 15. For this purpose, side 16 of sagger 12*a* terminates short of the lower edges of that sagger to define exit port 17, and two sides of sagger 12*a* adjacent to side 16 are extended by projections 18 having flanges turned toward each other to define channels in which gate 15 vertically moves. A lip 19 of the L-shaped gate serves as reinforcement and as a finger grip. Each of the four sides of each sagger preferably has a cut-away slot 20 which serves a dual purpose of providing air-circulation vents as well as openings for finger grips when it is desired to move individual saggers.

Figure 4:
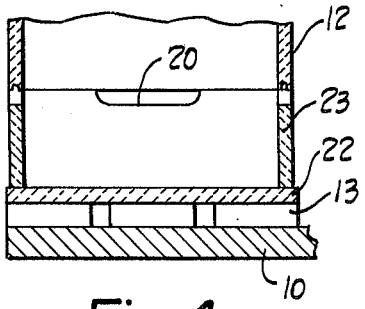
FIG. 4 is a fragmentary cross-section, similar to FIG. 2, and illustrates other closure constructions for the bottommost sagger of a column.

While a bottommost sagger should have exit means, it need not have an integral floor 14 as shown in the embodiment of FIGS. 1, 2 and 3. FIG. 4 illustrates two other arrangements, each of which may be used alone or in combination with each other. For example, a slab 22 of the same refractory material as used to cast the saggers may underseat the bottommost sagger 23 and support the column of overhead saggers. In this case, sagger 23 is like the other saggers of the column (both topless and bottomless) except that it has exit means such as the gate 15 of FIG. 3. Where the size of the refractory articles to be contained within the column of saggers, such as the diameters of grinding balls, is greater than the greatest distance between the undergirding bricks 13, both of floor 14 and unattached slab 22 may be eliminated and the bricks alone used. In this case sagger 23 also can be used as the bottommost sagger.

Figure 5:
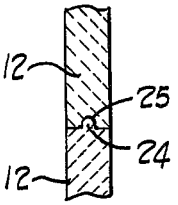
FIG. 5 is a fragmentary cross-section of adjoining sides of two adjacent saggers and illustrates one construction for interengaging such sides.

Preferably, the saggers of each column C have means to maintain them in substantial vertical alignment. The adjoining edges of two adjacent saggers may be shaped to interlock or interengage. FIG. 5 illustrates one structure which can be used for this purpose. The upper edge of one sagger 12 has a ridge 24, while the lower edge of an adjacent sagger 12 has a groove 25 which tightly receives the ridge. In this manner, the saggers are kept from lateral movement with respect to each other.

In use, a laborer initially forms columns of saggers on a kiln car, such as is shown in FIG. 1, by individually placing each unloaded sagger in position in the manner illustrated. If, in lieu of individual saggers, one large integral column equal in height to all of the saggers were used, a single laborer could not handle the column. Two or more laborers would be required and possibly a cable-lifting apparatus by which to hoist the column. However, there are still other advantages to preserving the individual character of the saggers as hereinafter described.

Once the sagger columns are formed, they remain in place on the kiln car for an appreciable number of runs through the kiln, during which time the saggers are not disassembled or reassembled. It is, therefore, not necessary to remove the saggers individually or to remount them in like manner as compared to the present practice of loading and unloading each sagger on a kiln car before and after each pass through a kiln. Reduction in the amount of handling the saggers also reduces the amount of breakage.

The sagger columns are loaded by gravity at the top of the topmost sagger which defines an entrance to the column. For example, a column C may be filled with green, unfired balls of refractory material shown at 26 in FIG. 2. The entire column may be filled to the very top. In this manner balls 26 are packed in a higher density without choking air circulation through the columns. In fact, the present sagger construction provides both a substantial increase in payload with an increase in the volume of air circulation as compared to the case where the saggers have bottoms. In some cases, sagger capacity has been increased as much as 60% and higher, with resultant savings as well in fuel costs. After the saggers and their charges of refractory material have been fired in a kiln and then removed, it is necessary only to lift gate 15 and empty columns C by gravity. Thereafter, the operation is repeated as described.

There are additional reasons for maintaining the individual character of the saggers. Individual saggers are much easier to fabricate as compared to an integral column equal in height to several saggers. Also, should a single sagger crack or become bowed in service, it is necessary only to replace that sagger rather than the entire column which would be the case if the column were integral. Still further, different saggers of column C may be subject to different stresses, heat stresses and otherwise. Periodically, after a number of heats, the saggers in a given column may be rearranged or rotated and thereby promote even wear and deterioration on all of the saggers. This has the further advantage of increasing the useful life of the saggers.

The present sagger construction, therefore, increases the amount or volume of articles that can be loaded in a column of saggers while simultaneously actually improving the amount of air circulation through the column as compared to prior techniques. Additionally, this is also accomplished while prolonging the useful life of the saggers and greatly diminishing labor requirements.

Although the foregoing describes several embodiments of the present invention, it is understood that the invention may be practiced in still other forms within the scope of the following claims.

I claim:

1. Apparatus of the class described including a plurality of bottomless and topless, separable, closed frame members defining sagger means stacked atop each other to form a columnar enclosure substatially free of internal support, one of said frame members adjacent the bottom of said columnar enclosure having exit means mounted on the exterior of said one frame member for reciprocation between closed and open positions.

2. Sagger construction for holding refractory articles during the firing thereof, said construction comprising generally at least two separable, bottomless, topless multi-sided sagger members placed atop each other in substantially vertical alignment to define a hollow column adapted to contain said refractory articles and being substantially free of internal support for such articles, the topmost sagger member defining an entrance to the column, and the bottommust sagger member having closure means along the bottom thereof and containing exit means for release of said refractory articles, said exit means being mounted on the exterior of said bottom most sagger member for reciprocation between closed and open positions in a direction generally parallel to a longitudinal axis of said hollow column.

3. The sagger construction of claim 2 in which said sagger members comprise fired refractory material.

4. The sagger construction of claim 2 in which adjacent sagger members have interengaging means to aid in retaining said members in said substantially vertical alignment.

5. The sagger construction of claim 2 in which said closure means for the bottommost sagger member comprises slab means adapted to underseat said bottommost sagger member.

6. The sagger construction of claim 2 in which said closure means for the bottommost sagger member comprises a bottom integral with the multi-sides of said bottommost sagger members along their lower edges.

7. The sagger construction of claim 2 in which said closure means for the bottommost sagger member comprises spaced-apart brick means adapted to raise the substantially vertically aligned sagger members and aid in air circulation throughout the columnar enclosure.

8. The sagger construction of claim 2 in which said exit means includes slidable gate means.

9. The sagger construction of claim 2 in which said exit means includes slidable gate means, and said bottomless sagger member includes channel means formed therewith to receive said slidable gate means for reciprocation therein.

10. The sagger construction of claim 2 in which said exit means includes slidable gate means, and said gate means has grip means.

* * * * *